US007730928B2

(12) United States Patent
Stone et al.

(10) Patent No.: US 7,730,928 B2
(45) Date of Patent: Jun. 8, 2010

(54) OVERHEAD SECTIONAL DOOR, HINGE AND STILE ASSEMBLY

(75) Inventors: Jeffrey W. Stone, Lebanon, OH (US); Alan R. Leist, Cincinnati, OH (US); John A. Colston, Mason, OH (US)

(73) Assignee: Clopay Building Products Co., Inc., Mason, OH (US)

( * ) Notice: Subject to any disclaimer, the term of this patent is extended or adjusted under 35 U.S.C. 154(b) by 1024 days.

(21) Appl. No.: 11/376,904

(22) Filed: Mar. 16, 2006

(65) Prior Publication Data

US 2007/0215293 A1 Sep. 20, 2007

(51) Int. Cl.
*E05D 15/00* (2006.01)

(52) U.S. Cl. ..... 160/201; 16/DIG. 1

(58) Field of Classification Search ..... 160/201, 160/229.1, 232, 235, 209, 236; 16/382, 386, 16/DIG. 1

See application file for complete search history.

(56) References Cited

U.S. PATENT DOCUMENTS

| | | | | |
|---|---|---|---|---|
| 1,994,142 | A | | 3/1935 | Madsen |
| 2,134,397 | A | | 10/1938 | Clark |
| 2,233,351 | A | | 2/1941 | Rowe |
| 2,391,845 | A | * | 12/1945 | Rowe ..... 160/201 |
| 3,376,913 | A | | 4/1968 | Clapsaddle |
| 4,119,133 | A | | 10/1978 | Wolf |
| 4,183,393 | A | | 1/1980 | Bailey |
| 4,485,544 | A | | 12/1984 | Van Ryswyk |
| 4,492,067 | A | | 1/1985 | Martin et al. |
| 5,188,163 | A | | 2/1993 | Schwartzengraber et al. |
| 5,551,125 | A | | 9/1996 | Adams |
| 5,782,283 | A | | 7/1998 | Kendall |
| 5,857,510 | A | | 1/1999 | Krupke et al. |
| 5,884,363 | A | | 3/1999 | Tofts |
| 5,913,352 | A | | 6/1999 | Scates et al. |
| 5,921,307 | A | | 7/1999 | Ford et al. |

(Continued)

OTHER PUBLICATIONS

International Searching Authority, The International Search Report and the Written Opinion of the International Searching Authority, or the Declaration, PCT/US2006/047645, Dec. 14, 2006, 12 pgs.

*Primary Examiner*—David Purol
(74) *Attorney, Agent, or Firm*—Wood, Herron & Evans, LLP

(57) ABSTRACT

A hinge assembly pivotally couples adjacent panels together in an overhead sectional door. The panels include stiles between each lateral end of the panel to which the hinge assemblies are attached. The hinge assembly includes an upper hinge leaf on an upper panel with a pair of spaced generally parallel flanges which span the juncture between the upper and lower panels. The hinge assembly also includes a lower hinge leaf with a pair of flanges projecting generally parallel to each other. The lower hinge leaf is mounted to one of the stiles of the lower panel and each flange includes a pivot axis hole near a terminal end thereof for alignment with a pivot axis hole in one of the flanges of the upper leaf. The stile includes a pair of spaced, parallel sidewalls and a notch, depression or recess is on each sidewall. The recesses provide a seat for the respective flanges of the hinge leaves and clearance between the sidewall of the stile and any adjacent components. A rivet or similar pivotal connector device is seated within the pivot axis holes on each side of the hinge.

16 Claims, 6 Drawing Sheets

U.S. PATENT DOCUMENTS

| | | | |
|---|---|---|---|
| 6,006,817 | A | 12/1999 | Stone et al. |
| 6,076,590 | A | 6/2000 | Ford et al. |
| 6,328,091 | B1 | 12/2001 | Whitley |
| 6,578,619 | B2 | 6/2003 | Wright |
| 6,626,226 | B2 | 9/2003 | Whitley |
| 6,629,387 | B2 | 10/2003 | Whitley et al. |
| 6,640,872 | B1 | 11/2003 | Mullet |
| 6,672,362 | B1 | 1/2004 | Mullet et al. |
| 6,679,310 | B2 | 1/2004 | De Zen |
| 6,698,492 | B2 | 3/2004 | Lewis, Jr. |
| 6,725,898 | B2 | 4/2004 | Mullet et al. |
| 6,772,814 | B2 | 8/2004 | Leist et al. |
| 6,810,938 | B2 | 11/2004 | Aquilina |
| 6,843,300 | B2 | 1/2005 | Mullet et al. |
| 6,883,578 | B2 | 4/2005 | Whitley |
| 2002/0078529 | A1 | 6/2002 | Schwarz |
| 2004/0069422 | A1 | 4/2004 | Hormann |
| 2004/0099382 | A1 | 5/2004 | Mullet et al. |
| 2004/0103997 | A1 | 6/2004 | Mullet |
| 2004/0168777 | A1 | 9/2004 | Kelley |
| 2005/0183834 | A1 | 8/2005 | Smallwood et al. |

* cited by examiner

OVERHEAD SECTIONAL DOOR, HINGE AND STILE ASSEMBLY

BACKGROUND OF THE INVENTION

This invention relates to overhead doors and, more particularly, to hinges for coupling overhead sectional door panels together.

There are numerous designs of overhead or retractable door assemblies which are commonly used for garage doors, truck doors, warehouse doors or the like. Typically, an overhead door is convertible between an open, overhead or generally horizontal configuration and a closed generally vertical configuration in which the door closes an opening in the building or the like. The overhead door commonly moves along a track assembly mounted proximate the opening and the track assembly usually includes a generally vertical track section, a generally horizontal track section and a curved transition track section joining the horizontal and vertical sections together.

Overhead doors of this type conventionally include a number of vertically arranged, horizontally oriented panels which can fold along the horizontal divisions between the panels to allow the door to pass along the curved transition section of the track when being opened or closed. The panels can be pivotally coupled together with hinges on the interior surface or back face of the door panels. The hinges articulate during pivotal movement of the panels. Such door panels for many years were predominantly constructed of wood. However, wood door panels are both costly to manufacture and heavy in use, resulting in difficulty when opening and closing the garage door.

Recently, sectional overhead door panels with an outer metal or thermoplastic skin have become popular and have replaced wooden door panels in many applications. Commonly, sectional overhead door panels with thin outer skins require internal reinforcing members, typically constructed of wood or metal. Vertically oriented center and end stiles are often provided within the thin sheet door panel for the required reinforcement.

However, no single overhead door panel design satisfies the needs of all applications and installations. In addition to skin thickness and strength, a wide range of other panel characteristics may be altered for the appropriate panel design for a given application. Some designs are referred to as "pan" door panels and include only the thin skin material for the front face and upper/lower edges of the panel and the required reinforcing stiles and hinge components. Other designs are partially or fully insulated and include a layer or insert of typically foam insulation inserted in the skin or pan portion of the panel. Some insulated door panel designs include a back face or skin and the insulation is sandwiched between the front and back skins.

Regardless of the particular overhead door panel configuration and design, the individual panels must be pivotally joined together for articulation between open and closed positions and movement along the associated track structure. Moreover, an overhead door manufacturer and an installer of overhead doors finds it much more efficient and economical to manufacture, sell, stock and handle a minimum variety of components. Preferably, a given component such as a hinge assembly is compatible with a variety of overhead door panel designs and configurations. This allows the installer and manufacturer to efficiently utilize a minimum number of components while accommodating each of the various door designs.

The installation process for an overhead door is greatly simplified if various components, including the hinge assembly, can be provided in a preassembled configuration for application and installation on the overhead door. However, typically components such as hinges are uniquely designed for a particular door application, particularly when the door panel configuration is designed to minimize gaps between the adjacent door panels during articulation in an effort to inhibit and reduce pinch sites and associated hazards.

As evidenced by the above background, a need exists for a hinge design that is suited for use on a variety of overhead door panel designs and configurations while still affording the manufacturer and installer efficiencies in the manufacturing, stocking and installation processes.

SUMMARY OF THE INVENTION

The various embodiments of this invention offer these and other advantages over known overhead door, panel and hinge designs. In one embodiment, this invention includes a number of horizontally oriented panels vertically stacked one upon the other in edge-to-edge relationship. The panels are coupled to a track assembly mounted proximate the garage, warehouse, truck or other opening. The track assembly includes a generally vertical section, a generally horizontal section and a curved transition section joining the horizontal and vertical sections together. Rollers are mounted on the panels and coupled to the track assembly to guide the door between a closed generally vertical configuration with the upper and lower edges of the adjacent panels mated together and an open generally horizontal configuration extending generally parallel to the ceiling of the garage or the like.

The hinge assembly of this invention pivotally couples adjacent panels together in an overhead sectional door. Each door panel includes a front skin presenting an exterior face and may include a back skin presenting an interior face. The panels in one embodiment each have mating upper and lower edges that have generally segmented convex and concave profiles to mate with each other during the operation of the door. The panels include stiles between each lateral end of the panel to which the hinge assemblies are attached. The stiles extend generally vertically between the upper and lower edges of the panels. In some embodiments of this invention, each stile is seated within a channel section on the back face of the panel.

The hinge assembly in one embodiment includes an upper hinge leaf bolted, screwed or otherwise secured along its base plate to a stile of an upper panel. The upper hinge leaf includes a pair of spaced generally parallel flanges which project rearwardly away from the base plate and span the juncture between the upper and lower panels. Each flange terminates in a hinge arm that projects into the interior of the lower panel and toward the front face thereof. Each of the hinge arms includes a pivot axis hole near a terminal end thereof.

The hinge assembly also includes a lower hinge leaf that has a generally U-shaped profile with a pair of flanges projecting generally parallel to each other and perpendicular to its mounting base. The lower hinge leaf is bolted, screwed or otherwise mounted to one of the stiles of the lower panel and each flange includes a pivot axis hole near a terminal end thereof for alignment with one of the pivot axis holes in the hinge arms of the upper leaf. An arched flap projects upwardly and rearwardly from the upper edge of the mounting base on the lower hinge leaf.

The stile on which the lower hinge leaf is mounted in one embodiment has a generally U-shaped cross-sectional configuration. An outwardly directed bight portion of the stile is juxtaposed to the mounting base of the lower hinge leaf. The stile includes a pair of spaced, parallel sidewalls depending from the bight portion. Each sidewall of the stile includes a generally triangular-shaped notch, depression or recess adapted to have at least portions of the aligned flanges of the upper and lower hinge leaves seated therein. The recesses may be any appropriate shape such to provide a seat for the respective flanges and clearance between the sidewall of the stile and any adjacent components.

In one embodiment, the hinge does not have a single hinge pin that projects through all four pivot axis holes of the upper and lower hinge leaves. A rivet or similar mechanical device is seated within the pivot axis holes on each side of the hinge. In other words, the left side flange of the upper hinge leaf is pivotally connected to the left side flange on the lower hinge leaf by one such rivet and the right side flanges are likewise joined by another rivet.

As a result of the hinge assembly and stile design of this invention, an installer may receive and stock the hinges in an assembled configuration with the upper and lower hinge leaves pivotally coupled together. Once the door panels are aligned and seated one atop another, the assembled hinge is easily screwed, bolted or mounted to the stiles on the adjacent panels thereby avoiding timely manipulation and assembly of the hinge components. Moreover, the same hinge can be used on a wide variety of door panel designs including pan doors, sandwich doors, uninsulated doors, partially insulated doors and fully insulated doors.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
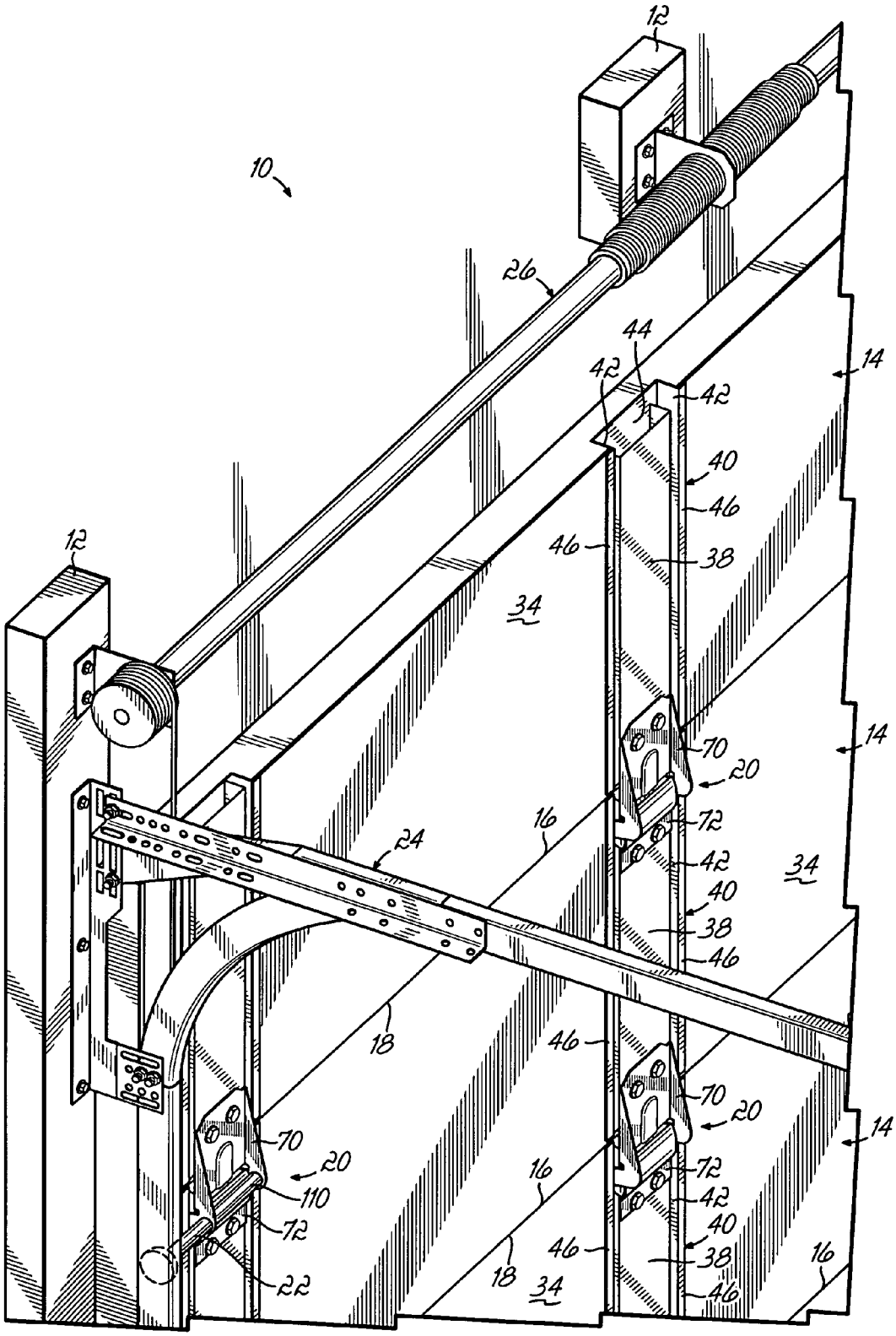
FIG. 1 is a perspective view of one embodiment of a sectional overhead door according to this invention.

Referring to FIG. 1, a one embodiment of a portion of an overhead door 10 according to this invention is shown in a closed generally vertical configuration covering an opening in a wall 12 of a garage, warehouse or the like. The door 10 includes a number of panels 14. Each panel 14 includes upper and lower generally horizontally oriented edges 16, 18 which are configured to mate with the lower and upper edges 18, 16 respectively, of an adjacent panel 14 when the door 10 is in the closed configuration as shown in FIG. 1.

The adjacent panels 14 are pivotally connected together by a number of hinge assemblies 20. The hinges 20 proximate the lateral side ends of each panel 14 include a roller assembly 22 for coupling the door 10 to a track assembly 24. The opening and closing of the door 10 may be assisted by a counterbalance system 26 coupled to the door 10 as is well known in the art.

Figure 6:
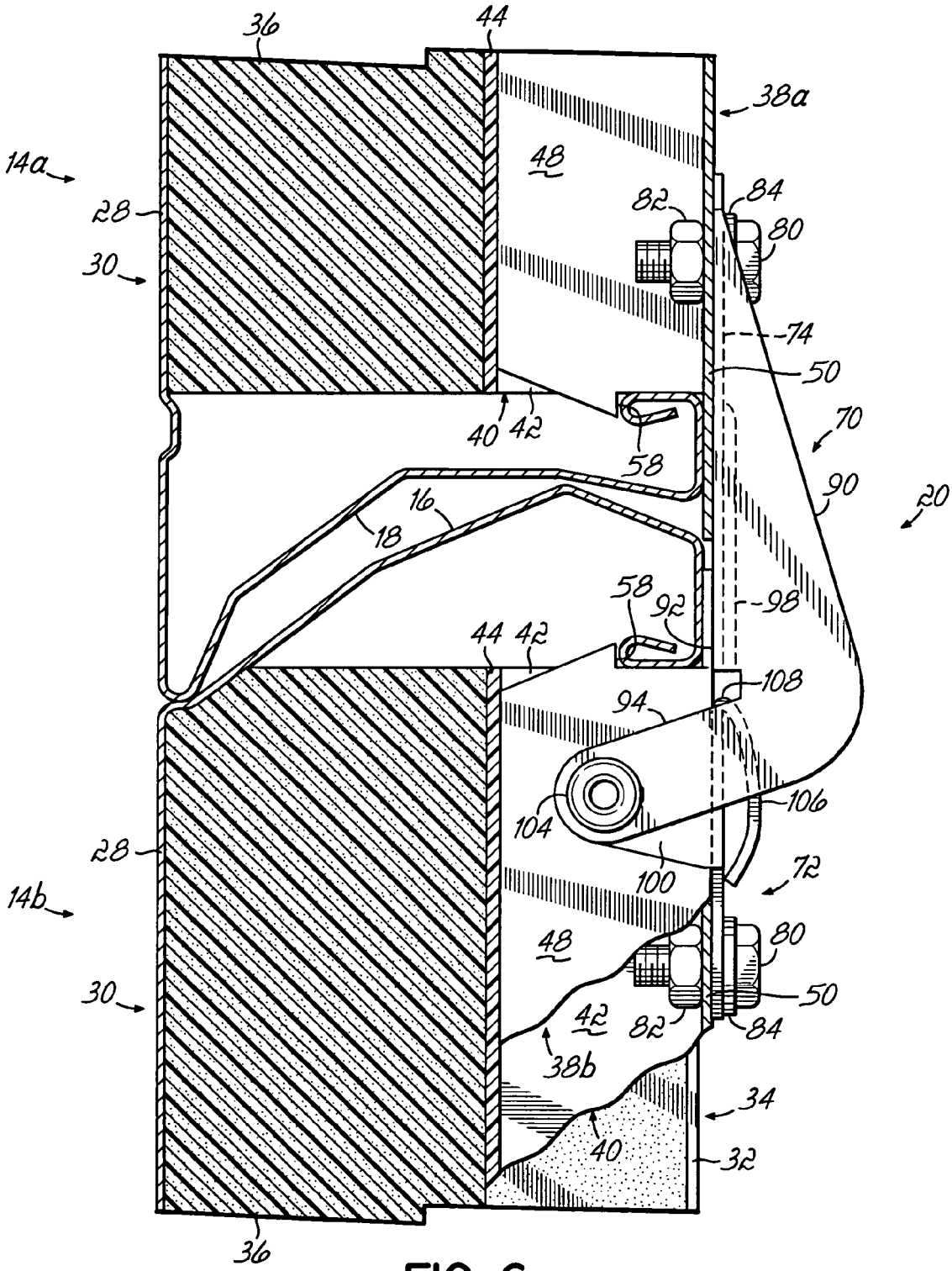
FIG. 6 is a cross-sectional view of a hinge assembly installed on adjacent panels of the overhead sectional door of FIG. 1.

Referring to FIG. 6, lower edge 18 of each panel 14 mates with the upper edge 16 of an adjacent panel 14 according to various embodiments of this invention. A more detailed disclosure of the convex/concave joint edge configuration according to one embodiment of this invention as shown in FIG. 6 is found in U.S. Pat. No. 6,006,817, assigned to the assignee of this invention and hereby incorporated by reference in its entirety. Nevertheless, this invention is readily employed on a panel design of another configuration such as a lap joint, a tongue and groove joint or other joint configuration.

Each panel 14 according to the various embodiments in this invention includes a front skin 28 defining a front face 30 of the panel 14 and may include a back skin 32 defining, at least in part, a back face 34 of the panel 14 (FIG. 1). Each panel 14 also includes the upper edge configuration 16 and a lower edge configuration 18 adapted to mate with corresponding lower and upper edges 18, 16, respectively, according to the specific configuration of the panels 14. According to some embodiments of this invention, the upper and lower edges 16, 18 are formed from the front skin 28 material. Generally, each of the skins 28, 32 may be embossed sheet metal or thermoplastic molded material according to embodiments of the invention. Insulation 36 may be provided to fill the internal volume defined by the front and back skins 28, 32 as is well known in the art. In such a case, an overhead door panel 14 has a sandwich configuration with the insulation 36 seated between the front and back skins 28, 32. Alternatively, the back skin 32 and/or the insulation 36 may be omitted to provide other door panel configurations within the scope of this invention.

Referring once again to FIGS. 1 and 6, the door panel 14 according to certain embodiments of this invention includes one or more stiles 38 oriented generally vertically and extending between the upper and lower edges 16, 18 of the panel 14. Commonly, the stiles 38 of one panel 14 are aligned with the stiles 38 on adjacent panels 14. Moreover, as shown in FIGS. 1-6, each hinge assembly 20 according to this invention is mounted to one or more stiles 38. In the embodiment of the panel 14 shown in FIGS. 1 and 6, each stile 38 is seated within a generally U-shaped channel 40 so that the stile 38 is generally flush with the back face 34 of the panel 14. As shown more clearly in FIG. 1, a cross section of the channel 40 is generally U-shaped with a pair of side walls 42 spaced on either side of a bottom wall 44 of the channel 40. The channel 40 includes longitudinally extending lips 46 juxtaposed to the back face 34 of the panel 14. The back skin 32 and channel 40 combination provide the back face 34 of the panel 14 with the stile 38 seated within the channel 40 and projecting rearwardly from the bottom wall 44.

Figure 4:
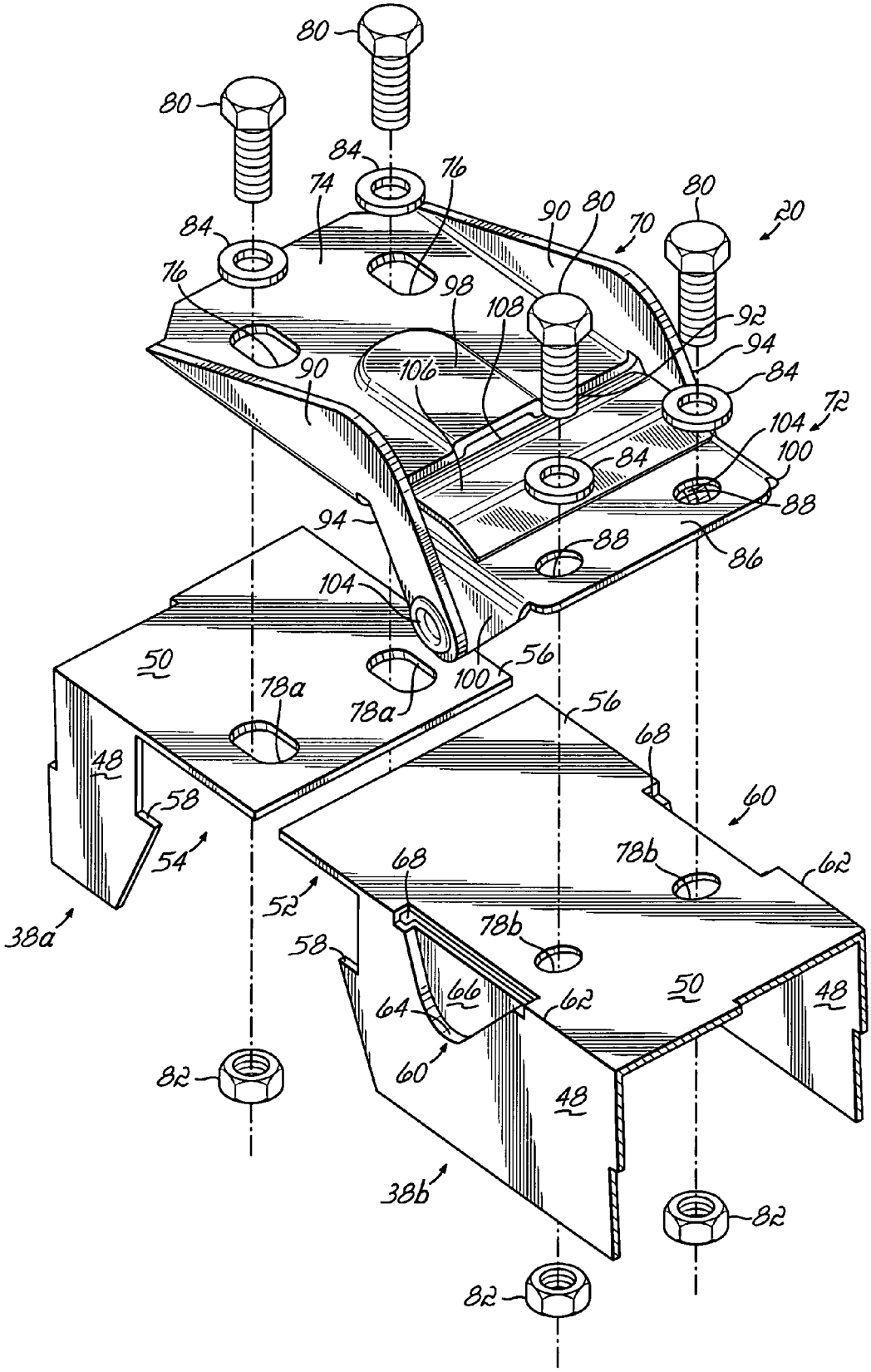
FIG. 4 is an exploded perspective view of the hinge assembly of FIG. 3 being installed on a pair of stiles of an overhead sectional door.
Figure 5:
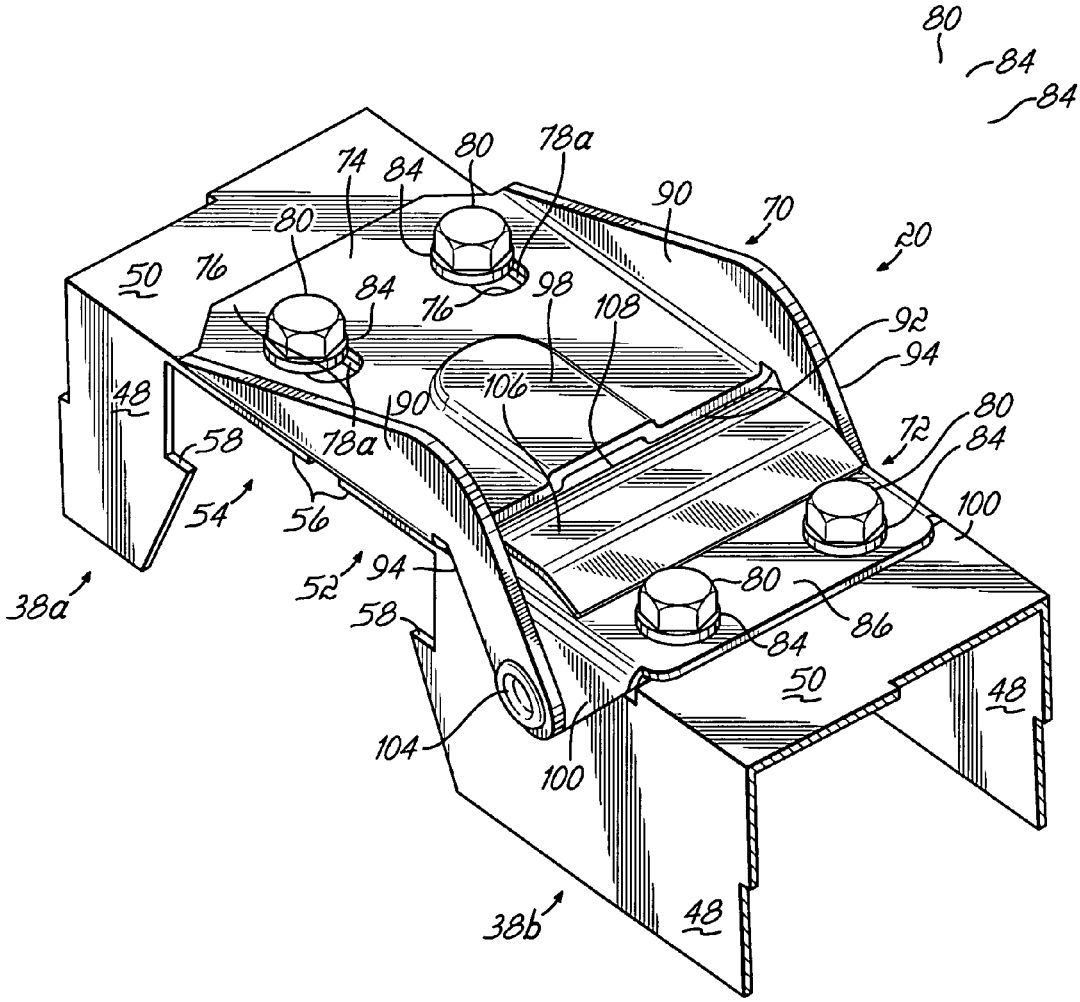
FIG. 5 is an assembled perspective view of the hinge assembly and stiles of FIG. 4.

As shown more clearly in FIGS. 4 and 5, each stile 38 according to one embodiment of this invention includes a pair of spaced generally parallel side walls 48 joined together by an outer bight portion 50 of the stile 38. The distal upper and lower ends 52, 54 of the bight portion 50 of the stile 38 may include an extension 56 and the side walls 48 may include a hook-shaped configuration 58, all of which are intended to mate the stile 38 with the upper and lower edge configurations 16, 18 of the panel 14 (FIG. 6).

One aspect of this invention is a recess, depression or well 60 in the side wall 48 of the stile 38 as shown primarily in FIG. 4. The recess 60 is located along an upper edge 62 of the side wall 48 at the juncture with the bight portion 50 and in one embodiment has a generally triangular-shaped configuration with a rounded lowermost seat 64 portion. The recess 60 may be any shape such as generally triangular as shown in FIG. 4, trapezoidal, rectangular or another shape. The innermost face 66 of the recess 60 is offset relative to the outer face of the side wall 48. In one embodiment, the stile 38 includes a cut-out 68 at the juncture 62 of the side wall 48 and the bight portion 50 along the upper edge of the recess 60. Removal of this material allows for stamping and bending of the metal utilized to form the stile 38. It should be readily understood that the orientation, configuration, location and other aspects of the recess 60 may be altered within the scope of this invention according to particular designs and applications.

Each hinge assembly 20 according to certain embodiments of this invention includes two primary components, an upper hinge leaf 70 and a lower hinge leaf 72. The upper hinge leaf 70 is mounted to a stile 38*a* on an upper panel 14*a* and, likewise, the lower hinge leaf 72 is mounted to the stile 38*b* on the lower panel 14*b*. The upper hinge leaf 70 includes a mounting base 74 which is juxtaposed to the bight portion 50 of the stile 38*a* on the upper panel 14*a*. The mounting base 74 includes two attachment holes 76 which are aligned with holes 78*a* in the stile 38*a* to receive the shank of a pair of bolts 80 inserted there through. Each bolt 80 is threadably coupled with a nut 82 on the bottom face of the bight portion 50 of the stile 38 to mount the upper hinge leaf 70 to the stile 38. A pair of washers 84 may be utilized with the bolts 80 for secure fastening. Similarly, the lower hinge leaf 72 has a generally planar mounting base 86 with a pair of mounting holes 88 which are aligned with holes 78*b* in stile 38*b* to receive bolts 80 to mount the lower hinge leaf 72 to the stile 38*b*. Alternatively, self-tapping screws or other mechanical fasteners may be used to mount the hinge leaves 70, 72 to the stiles 38*a*, 38*b*.

The upper hinge leaf 70 includes a pair of generally parallel flanges go which project upwardly from the mounting base 74 as mirror images of one another. Each mounting flange go extends beyond a lower edge 92 of the mounting base 74 to span the juncture between the adjacent panels 14. A hinge arm 94 is located at a distal end of each flange go and includes a pivot axis hole 96. The hinge arm 94 projects below the plane of the mounting base 74 as shown most clearly in FIG. 6. The mounting base 74 of the upper hinge leaf 70 may include a pocket 98 as necessary to flushly mount the mounting base 74 on the stile 38*a* and accommodate other components of the overhead door 10 seated within the pocket 98.

Figure 2:
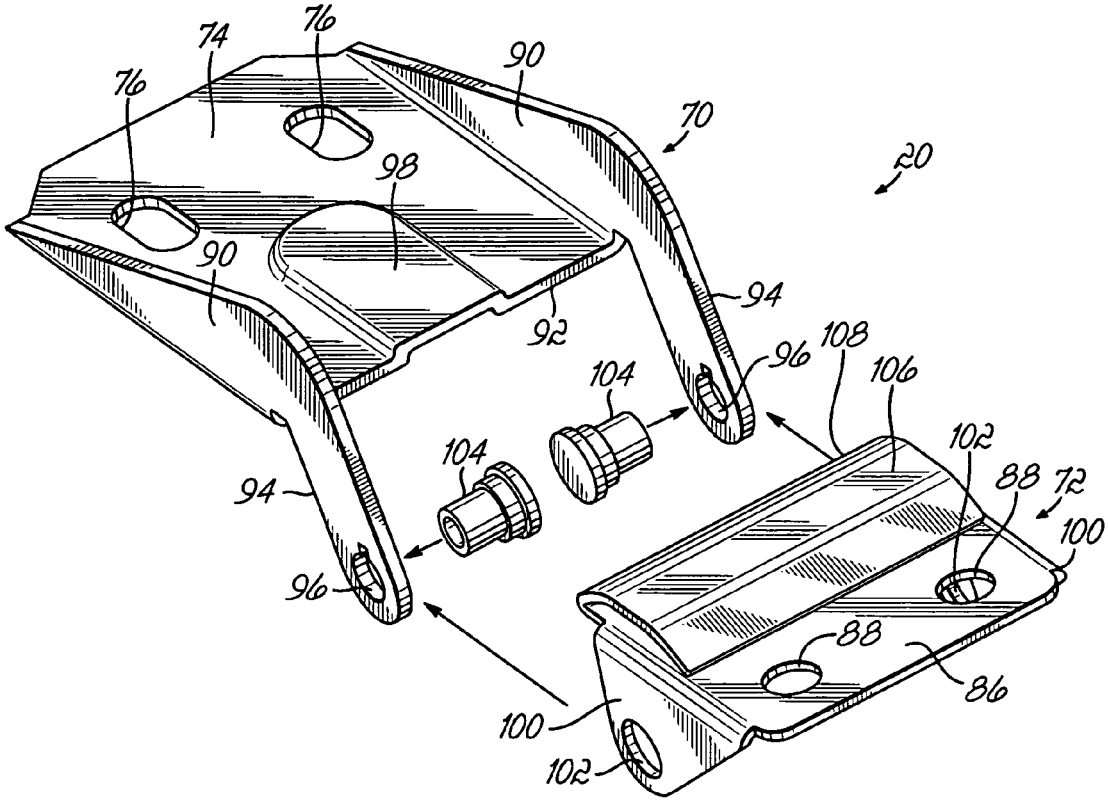
FIG. 2 is an exploded perspective view of a hinge assembly according to one embodiment of this invention.
Figure 3:
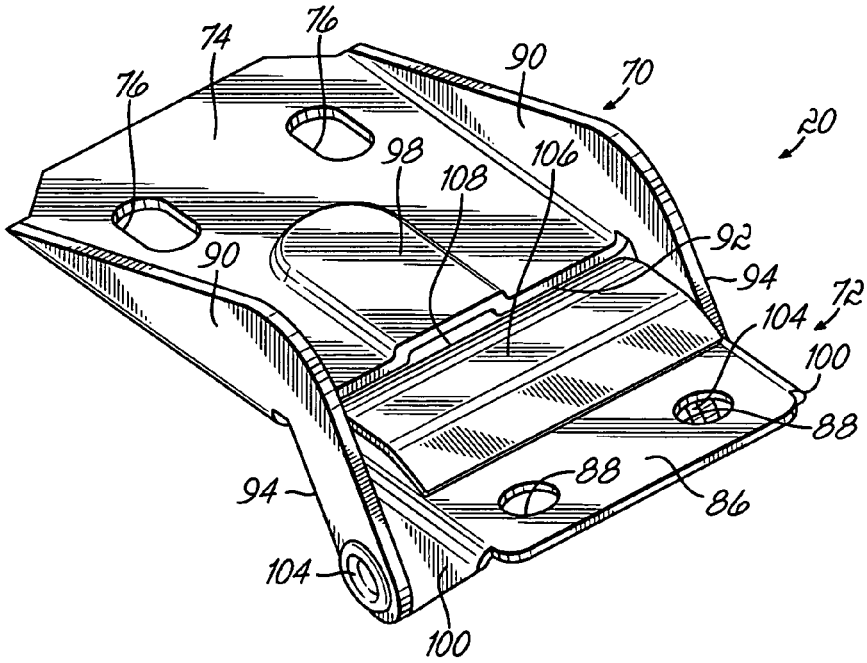
FIG. 3 is an assembled perspective view of the hinge assembly of FIG. 2.

The lower hinge leaf 72 has a generally U-shaped cross-sectional configuration with a pair of spaced flanges 100 depending downwardly from the mounting base 86. Each flange 100 of the lower hinge leaf 72 includes a pivot axis hole 102. The width of the lower hinge leaf 72 is sized and configured to fit between the hinge arms 94 of the upper hinge leaf 70 as shown in FIGS. 2 and 3. Each of the flanges 100 on the lower hinge leaf 72 have a generally triangular configuration and correspond to the contour of the recesses 60 in the stile 38*b* to allow the lower hinge leaf 72 to straddle the stile 38*b* with the flanges 100 seated within the recesses 60 as shown generally in FIG. 5.

The lower hinge leaf according to one embodiment also includes an upper flap 106 which extends from an upper edge 108 of the base 86 rearwardly in an arcuate configuration. The shape and configuration of the flap 106 minimizes the gap between the upper and lower hinge leaves 70, 72 during articulation of the hinge 20. Alternatively, the base 86 of the lower hinge leaf 72 may be formed with a bulge or the like which does not include the leaf extending from the upper edge to reduce the gap between the hinge leaves during articulation.

The hinges 20 located along the outboard lateral ends of the panels 14 may include a roller mount 110 adapted to receive the roller assembly 22 to couple the panels 14 to the track assembly 24. In one embodiment, the roller mount 110 may be located on the upwardly projecting portions of the flanges go on the upper hinge leaf 70.

The corresponding hinge arm 94 and flange 100 on each side of the hinge assembly 20 are pivotally coupled together by a rivet 104 or similar pivotal connector device inserted though the pivot axis holes 96, 102 as shown in FIG. 2. Advantageously, the hinge 20 in this embodiment does not include a single pivot pin or other structure that extends from one side of the hinge 20 to the other to span the stile 38. As such, the U-shaped lower hinge leaf 72 with the hinge arms 94 of the upper hinge leaf 70 pivotally coupled by the pair of rivets 104 may be mounted on the stile 38 with the associated portions of the flanges 90, 100 of the hinge leaves 70, 72 seated within the recesses 60.

The combination of the upper and lower hinge leaf 70, 72 design and the recesses 60 in the side wall 48 of the stile 38 provides numerous advantages to an overhead sectional door 10 of this invention. For example, the hinge components may be preassembled with the rivets 104 joining the associated flanges 90, 100 of the upper and lower hinge leaves 70, 72 together and supplied in the assembled configuration to an installer who can then easily and conveniently mount the assembled hinge 20 to the exposed stiles 38 on the door panels 14 without the need to take the time and effort to manipulate the hinge, assemble the hinge components and install the hinge as is required with many other known hinge designs. Additionally, the hinge assembly 20 may be utilized on a wide variety of panel designs and configurations including a sandwich or fully insulated panel such as shown in FIG. 6 as well as with non-insulated or semi-insulated panel designs. This minimizes the inventory and variety of components required for manufacturing and assembling various door configurations and designs.

Figure 7:
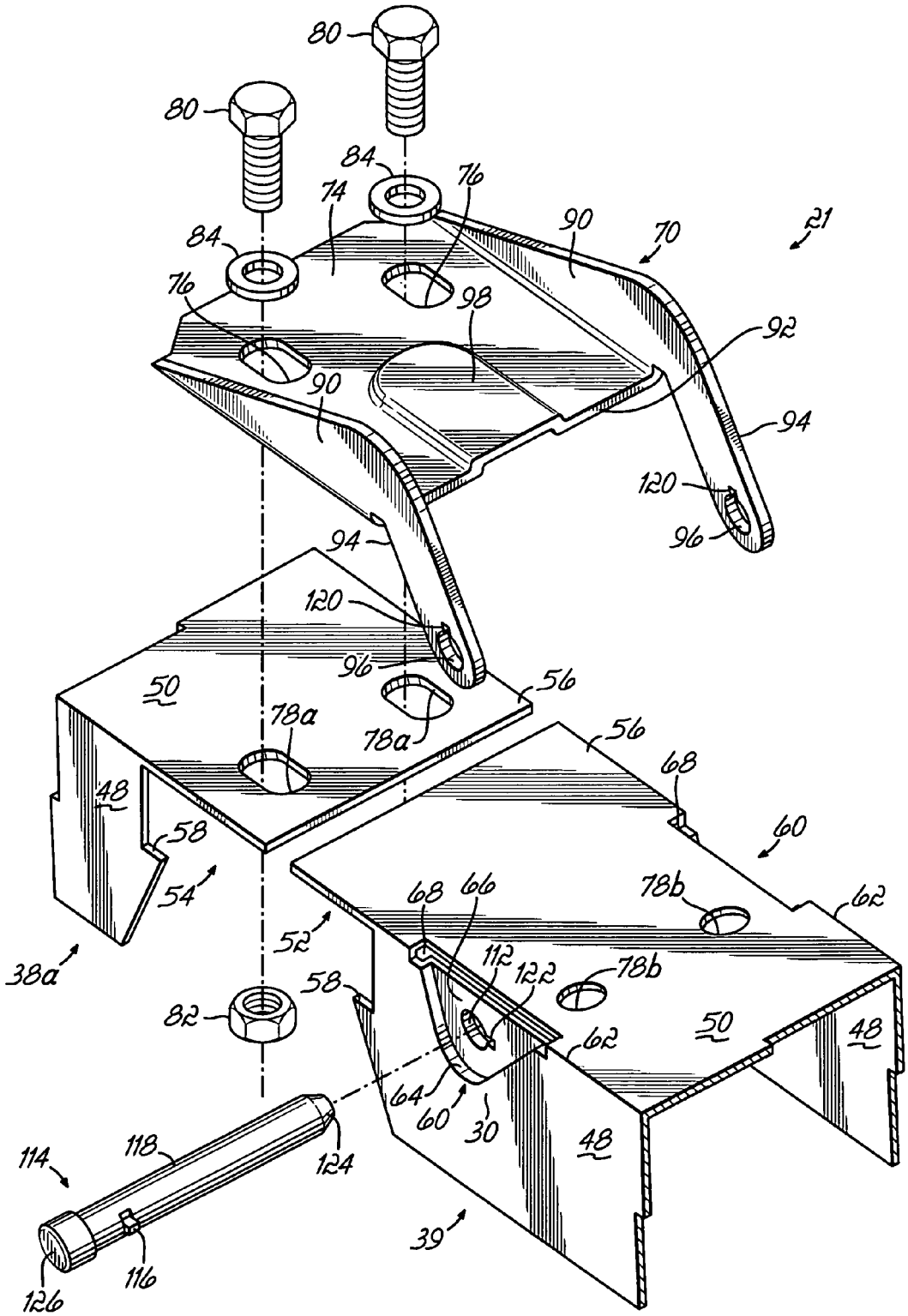
FIG. 7 is an exploded perspective view of an alternative hinge assembly being installed on a pair of stiles of an overhead sectional door.

An alternative embodiment of the stile 39 and hinge assembly 21 is shown in FIG. 7. The hinge assembly 21 includes the upper hinge leaf 70 which is pivotally coupled directly to the stile 39 on the lower panel 14*b*. The stile 39 includes a pivot axis hole 112 in the inner face 66 of the recess 60 on each side wall 48 of the stile 39. A pivot pin 114 is inserted through the hole 96 in the hinge arm 94 of the upper leaf 70. The pin 114 includes a key 116 projecting from a shaft 118 of the pin 114. The key 116 is sized and configured to pass through a keyway 120 in the hole 96 on the hinge arm 94 as well as a keyway 122 in the hole 112 in the recess 60. After the upper leaf 70 is pivoted relative to the stile 39 to align the keyways 120, 122, a tip 134 of the pin 114 and the key 116 is inserted through the keyways 120, 122. The hinge arm 94 is then pivoted relative to the stile 39 to thereby misalign the keyways 120, 122 relative to each other and capture the key 116 in the stile 39. A head 126 of the pin 114 prevents the pin 114 from passing entirely through the holes 96, 112.

As such, the stile 39 with pivot axis holes 112 in the recesses 60 can be utilized with either hinge assembly 20 (FIG. 3) or 21 (FIG. 7) thereby reducing the additional, unique components that need to be stocked for a variety of door configurations and designs, including a fully insulated, sandwich, or pan door embodiment.

It should be readily appreciated that although certain embodiments and configurations of the invention are shown and described herein, the invention is not so limited. From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. An overhead door capable of being selectively moved between a generally horizontal open position and a generally vertical closed position covering an opening, the door comprising:

a plurality of serially connected panels each having a front face, a top rail and a bottom rail, the top and bottom rails each being adapted to mate with the bottom rail and top rail, respectively, of an adjacent panel;

a track assembly mounted proximate the opening, the track assembly including a generally vertical section, a generally horizontal section and a transition section joining the horizontal and vertical sections together;

a plurality of rollers mounted on the panels and coupled to the track assembly to guide the door between the closed and open positions;

a plurality of stiles each mounted to one of the panels and extending between the top and bottom rails;

a recess in a sidewall of at least selected stiles;

a plurality of hinge assemblies each mounted to the adjacent panels to pivotally couple the adjacent panels together, wherein each of the hinge assemblies further comprises, (a) a first hinge leaf mounted to a first one of the panels;

(b) a second hinge leaf mounted to one of the stiles on a second one of the panels adjacent to the first panel;

(c) a pair of first hinge leaf flanges spaced from each other and projecting from the first hinge leaf toward the second hinge leaf; and (d) a pair of second hinge leaf flanges spaced from each other a distance less than an outer perimeter width of the stile and projecting from the second hinge leaf;

wherein the first and second hinge leaf flanges are pivotally coupled together and at least portions of the first and second hinge leaf flanges are seated within the recess in the one stile on the second one of the panels;

a first mounting base on the first hinge leaf mounted to one of the stiles on the first panel;

a second mounting base on the second hinge leaf;

a bight portion of the one stile on the second one of the panels, the bight portion separating a pair of stile sidewalls and the second mounting base being mounted to the bight portion; and a pair of pivotal connectors each joining one of the first hinge leaf flanges to one of the second hinge leaf flanges;

wherein each pivotal connector does not span the associated stile and is seated in the associated recess.

2. The overhead door of claim 1 further comprising:

a pair of the recesses each on one of the sidewalls of the one stile on the second one of the panels, each of the pivotal connectors being seated in one of the recesses along with at least portions of the associated first and second hinge leaf flanges.

3. The overhead door of claim 1 wherein each panel has a back face, the overhead door further comprising:

a plurality of channels each on the back face of one of the panels, each of the stiles being seated in one of the channels.

4. The overhead door of claim 3 further comprising:

a back skin on each of the panels, each back skin and each channel on the associated panel contributing to form the back face.

5. The overhead door of claim 1 wherein the flanges of the first and second hinge leaves project toward the front face of the second panel.

6. The overhead door of claim 1 wherein the flanges of the first and second hinge leaves are generally parallel to each other.

7. The overhead door of claim 1 wherein a cross-sectional configuration of the second hinge leaf is generally U-shaped and a cross-sectional configuration of the stiles is generally U-shaped and the U-shaped cross-sectional configurations of the second hinge leaf and the stile to which it is mounted are similarly oriented and nested together.

8. The overhead door of claim 1 wherein the recess is generally triangular shaped.

9. The overhead door of claim 1 further comprising:

a roller mount on selected hinge assemblies, each of the rollers being mounted to one of the roller mounts.

10. The overhead door of claim 1 further comprising:

an insulation insert seated on each panel and extending substantially from the top rail to the bottom rail.

11. The overhead door of claim 1 further comprising:

a projection extending outwardly from the second mounting base of the second hinge leaf, the projection being sized and configured to reduce a spacing between the first and second hinge leaves during articulation of the hinge assembly.

12. The overhead door of claim 1 wherein each stile has a pair of sidewalls separated by a bight portion and a portion of the sidewall at the recess being offset relative to a remainder of the sidewall to define a width of the stile at the recesses less than an outer perimeter width of the stile at the remainder of the sidewall; and a plurality of channels each on the back face of one of the panels, each of the stiles being seated in one of the channels;

wherein at least portions of the first and second hinge leaf flanges and the associated pivotal connector are seated within one of the recesses in the one stile on the second one of the panels.

13. The overhead door of claim 12 wherein a cross-sectional configuration of the second hinge leaf is generally U-shaped and a cross-sectional configuration of the stiles is generally U-shaped and the U-shaped cross-sectional configurations of the second hinge leaf and the stile to which it is mounted are similarly oriented and nested together.

14. The overhead door of claim 1 wherein a pivot axis of each hinge assembly is aligned with the recess in the stile.

15. In an overhead door capable of being selectively moved between a generally horizontal open position and a generally vertical closed position covering an opening, the door having a plurality of serially connected panels mounted for movement to a track assembly mounted proximate the opening, the track assembly including a generally vertical section, a generally horizontal section and a transition section joining the horizontal and vertical sections together, each panel having at least one stile extending between top and bottom rails of the panel, the overhead door improvement comprising:

at least one recess in each of the stiles;

a plurality of hinge assemblies each mounted to two adjacent panels to pivotally couple the adjacent panels together, wherein each of the hinge assemblies further comprises, (a) a first hinge leaf mounted to a first one of the panels;

(b) a second hinge leaf mounted to one of the stiles on a second one of the panels adjacent to the first panel;

(c) a pair of first hinge leaf flanges spaced from each other and projecting from the first hinge leaf toward the second hinge leaf; and (d) a pair of second hinge leaf flanges spaced from each other a distance less than an outer perimeter width of the stile and projecting from the second hinge leaf;

wherein the first and second hinge leaf flanges are pivotally coupled together and at least portions of the first and second hinge leaf flanges are seated within the recess in the one stile on the second one of the panels;

a first mounting base on the first hinge leaf mounted to one of the stiles on the first panel;

a second mounting base on the second hinge leaf;

a bight portion of the one stile on the second one of the panels, the bight portion separating a pair of stile sidewalls and the second mounting base being mounted to the bight portion; and a pair of pivotal connectors each joining one of the first hinge leaf flanges to one of the second hinge leaf flanges and defining a pivot axis aligned with the recess;

wherein each pivotal connector does not span the associated stile and is seated in the associated recess.

16. The overhead door of claim 15 further comprising:

a pair of the recesses each on one of the sidewalls of the one stile on the second one of the panels, each of the pivotal connectors being seated in one of the recesses along with at least portions of the associated first and second hinge leaf flanges.

* * * * *

UNITED STATES PATENT AND TRADEMARK OFFICE

CERTIFICATE OF CORRECTION

PATENT NO. : 7,730,928 B2
APPLICATION NO. : 11/376904
DATED : June 8, 2010
INVENTOR(S) : Jeffrey W. Stone et al.

It is certified that error appears in the above-identified patent and that said Letters Patent is hereby corrected as shown below:

In column 5, line 35, "flanges go which", should read --flanges 90 which--.

In column 5, line 36, "flange go", should read --flange 90--.

In column 5, line 39, "flange go and includes", should read --flange 90 and includes--.

In column 6, lines 5-6, "flanges go on the upper", should read --flanges 90 on the upper--.

Signed and Sealed this

Twenty-eighth Day of September, 2010

David J. Kappos

David J. Kappos
*Director of the United States Patent and Trademark Office*